United States Patent [19]

Horrocks

[11] 4,120,557

[45] Oct. 17, 1978

[54] ELECTRICAL CONNECTOR

[75] Inventor: Raymond G. Horrocks, Fairview Park, Ohio

[73] Assignee: The Scott & Fetzer Company, Cleveland, Ohio

[21] Appl. No.: 826,480

[22] Filed: Aug. 22, 1977

[51] Int. Cl.[2] ..... H01R 13/06

[52] U.S. Cl. ..... 339/252 R; 339/258 R

[58] Field of Search ..... 339/95 R, 252 R, 252 P, 339/256 R, 256 C, 256 RT, 258 R, 258 A, 258 P, 258 RR, 262 R, 262 P, 262 RR

[56] References Cited

U.S. PATENT DOCUMENTS

| | | | |
|---|---|---|---|
| 3,453,587 | 7/1969 | Neidecker | 339/256 RT |
| 4,039,238 | 8/1977 | Johnson, Jr. et al. | 339/256 RT |

FOREIGN PATENT DOCUMENTS

| | | | |
|---|---|---|---|
| 637,065 | 10/1936 | Fed. Rep. of Germany | 339/258 A |
| 1,361,891 | 4/1964 | France | 339/252 R |

*Primary Examiner*—Joseph H. McGlynn

*Attorney, Agent, or Firm*—McNenny, Pearne, Gordon, Gail, Dickinson & Schiller

[57] ABSTRACT

An electrical connector is provided with a louvered interconnection strip in which the louvers provide edge pressure on the interconnection surface of one connector member, such as a plug or socket, and interior (non-edge) rib pressure on the complementary interconnection surface of the other connector member. Louver deflection does not cause substantial change in the length of the strip, and the strip can be provided as a closed annulus for use in plug-and-socket connectors in industrial applications such as connectors for portable cable for mining equipment.

12 Claims, 12 Drawing Figures

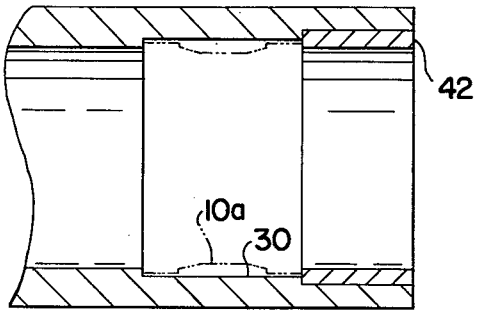
FIG. 8
FIG. 9
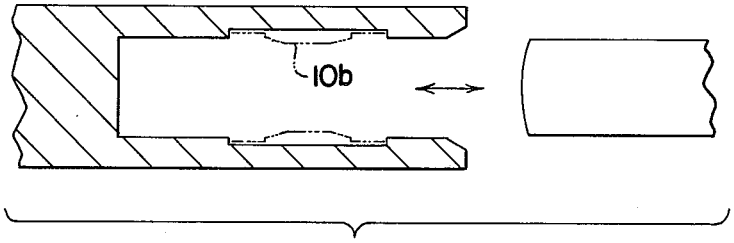
FIG. 10
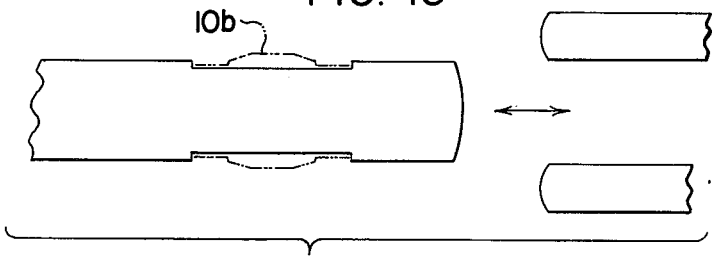
FIG. 11
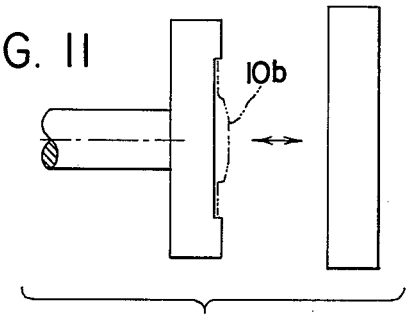

ELECTRICAL CONNECTOR

This invention relates to electrical connectors, primarily those of the plug-and-socket type in which complementary male and female members each define a cylindrical interconnection surface and electric current is transferred between such surfaces, although the invention also has utility for flat interconnections such as knife switches and the like.

Electrical connectors must meet adequate standards of ampacity, wear resistance, and short circuit survival for the particular applications in which they are used. Quick-disconnect portable cables for mining equipment is one example of a demanding environment in which such connectors are employed.

The ampacity of the connector refers to its ability to carry heavy loads, say 500 amps, for protracted periods without excessive heat buildup. The wear resistance of the connector relates to its ability to withstand repeated disconnection and reconnection without undue mechanical wear of the contact surfaces. The short-circuit survivability of the connector relates to its ability to continue to function normally after exposure to extremely heavy short circuit load, say 30,000 amps, for an interval of time, say 0.2 seconds, that equals or exceeds the expected time between (1) incidence of a short circuit condition and (2) operation of a protective circuit interrupting or unloading device.

One common connector in applications of this general type has consisted of a beryllium copper male plug element received in an electrolytic copper female sleeve insert, the plug being bored and transversly slit and tapered at one end to allow it to be compressed within the female member by sliding insertion to thereby establish pressurized surface-to-surface contact between the cylindrical interconnection surfaces defined by the male and female members. In such construction, the plug of beryllium copper is very costly because of the mass of metal involved and the basic cost of such metal. Also, the female member requires an electrolytic copper contact.

More recently connectors have been provided which utilize louvered twisting type flexible connector strips formed of relatively thin sheet metal. The louvers are resiliently twisted to be compressed between the cylindrical interconnection surfaces defined by the male and female connector members. Such members and their cylindrical interconnection surfaces may be formed entirely of bronze or brass, or even aluminum in some applications, without the use of electrolytic copper. The louvered connector strips may be formed of beryllium copper, but much less of this material is required than in connectors of the previous type. U.S. Pat. No. 3,453,587 of Neidecker relates to such a twisting type connector strip. U.S. Pat. No. 2,217,433 of Crabbs is an earlier example of use of a twisting type connector strip.

Strip type connectors, i.e. those utilizing louvered twisting type connector strips, present several problems. The louvers are designed to twist resiliently under the compressing action of insertion of the plug. Such resilient twisting assures that the radially inward and outward edges of the louvers will be tightly compressed against the cylindrical inner connection surfaces defined by the male and female connector members so as to provide sufficient edge pressure at both surfaces for adequate conduction between them. However such twisting must be accommodated by a change in length in the louvered strip to such a degree that the louvered strip cannot be fixed to itself as a closed annulus without reducing resilient contact force. In commercial practice the louvered strip is therefore formed as a split annulus when used in industrial applications such as portable cables for mining equipment.

Such louvered strips provided as split annuli may be mounted initially on either the male plug member or in the female receptacle member by means of appropriate retainers such as spring-wire clips for male mounting or undercut mounting grooves for female mounting. The louvers hold the annulus in permanently spaced relation with the interconnection surface of the male or female member on which it is mounted, and dirt can easily collect between the annulus and the interconnection surface of its mounting member. Attempts to remove the dirt involve a considerable risk of damage to the split annulus and particularly the unsupported ends thereof.

When simple removal and reinstallation of the louvered strip is attempted in the field for more thorough cleaning, or to prevent loss of temper in the springy strip when the connectors are subjected to high heat as in the course of soldering power leads to the connector members, it is difficult to complete the removal and reinstallation without a change in the shape or quality of the strip since, because the annulus is split, the strip must be handled as a long flexible string instead of as a self-supporting annulus. To properly remove the annulus from a male plug and then reinstall the annulus in proper relation with necessary retainer or mounting elements (such as spring-wire retainers or undercut grooves) without damage to the strip can be very difficult. The damage-free insertion of an unsupported long strip in a retaining slot within a female receptacle can also be very difficult to accomplish.

The present invention overcomes these problems with a new type of louver. No reliance is placed on a twisting action. Instead, contact pressure with the cylindrical interconnection surfaces is achieved by edge pressure on one surface and by interior (non-edge) rib pressure on the other surface. The edge pressure is applied at the edges of pairs of flanges on louvers formed as channel members in the strip, and the rib pressure is applied at the bases of the flanges. The channel members are folded out of the strip in a single radial direction in contrast to the extension of the louvers of the prior art strips in both radial directions from the strip. The deflection associated with compression of the strip is accompanied by so little change in strip length that in many applications the strip can be regarded as essentially unchanging in length and can be fabricated as a closed annulus. This annulus is mounted on a male or in a female connector member with the channel bottoms directly against the cylindrical interconnection surface of such mounting member and the channel flanges projecting radially for engagement with the cylindrical interconnection surface of the complementary connector member.

The result is a strip connector which guards against entrapment of dirt between the strip and the cylindrical interconnection surface of the associated mounting member, which can be cleaned without removal of the strip and without substantial risk of damage to the strip, and from which the strip can be readily removed and replaced for more thorough cleaning or for protection against loss of temper when the associated connector member is heated, as when it is being soldered. Also, damage-free replacement of old connector strips with new ones in the field for maintenance purposes is far more readily accomplished with the present connector than with prior strip-type connectors.

The invention is also advantageous when applied to louvered flat strips for knife switches, butt connectors, and the like. In such applications the strip is bottomed against a flat interconnection surface against which it is mounted instead of being spaced therefrom by projections of the louvers as required for the twist-deflection louvers of the prior art. The strip is therefore less prone to dirt entrapment and easier to clean than flat strips of the prior art.

The features and advantages of the invention will be more fully understood from the following description and the accompanying drawings. In the drawings, FIG. 1 is an isometric view of a connector strip embodying the invention.

Figure 3:
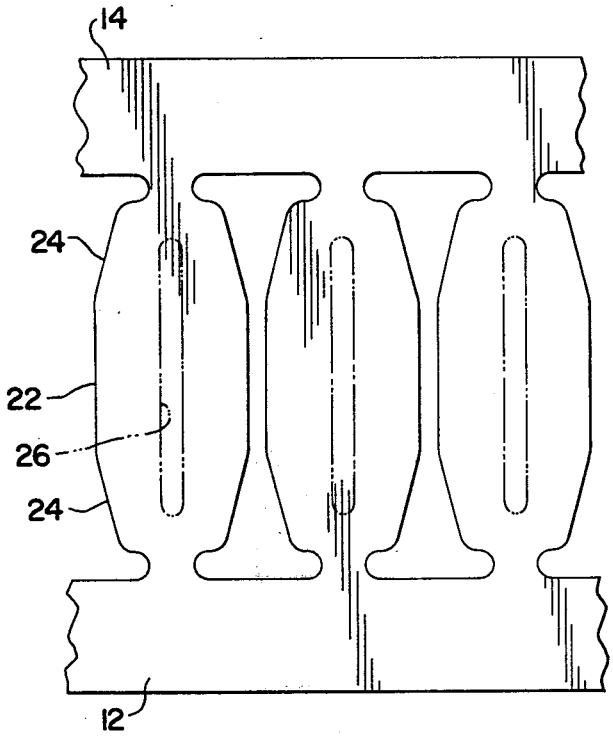
FIG. 3 is a planar development of a portion of the strip seen in FIG. 1 on a still larger scale, or it can be understood also as a plan view of the strip at an early state of its manufacture when it is flat.
Figure 3A:
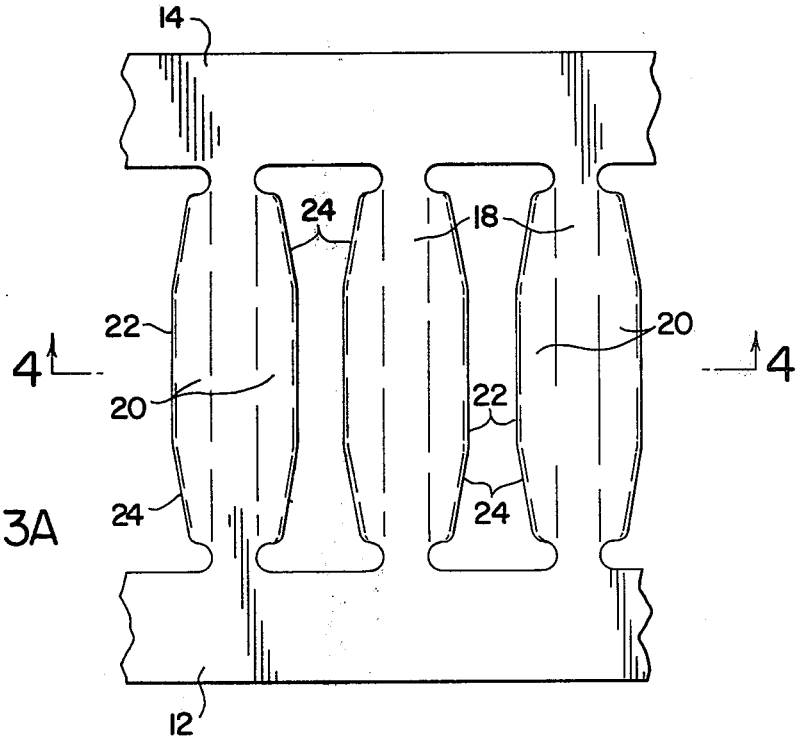

FIG. 3A differs from FIG. 3 only in that the illustrated louver flanges are shown in FIG. 3A upturned from the plane of development, and certain optional slots have been eliminated.

Figure 4:
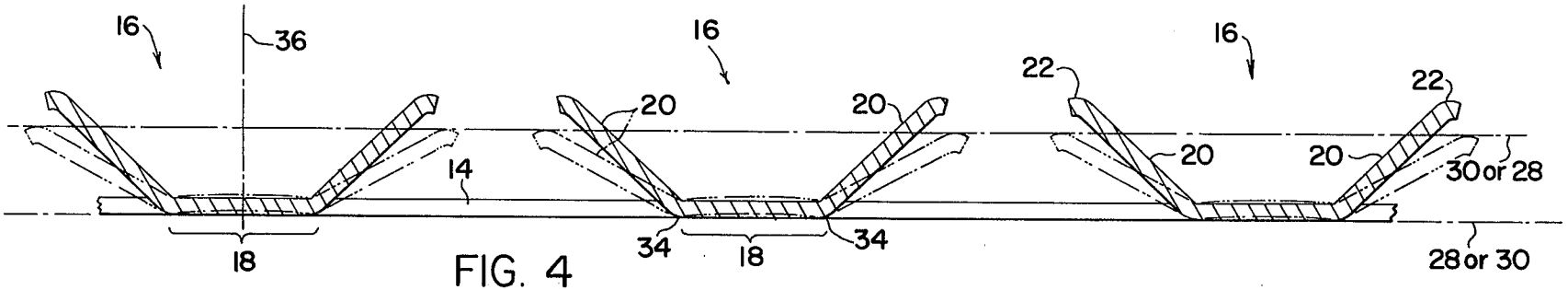

FIG. 4 is a cross section on a still larger scale taken at the plane of line 4—4 in FIG. 3A, and also showing side views of planar developments of the cylindrical interconnection surfaces of associated connection members.

Figure 5:
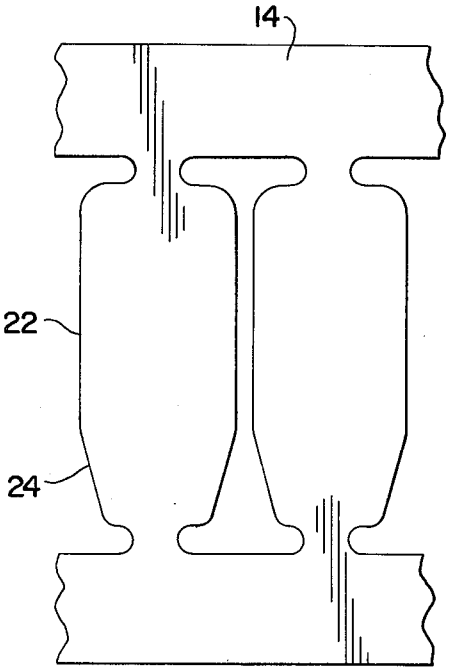

FIG. 5 is a view similar to FIG. 3 and differing only in that the illustrated louvers have flanges that are tapered only at one end in FIG. 5.

Figure 6:
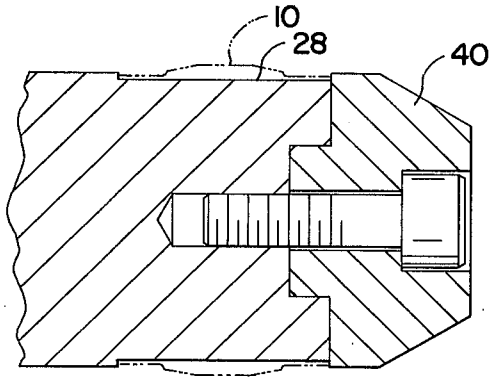

FIG. 6 illustrates the connector strip of FIGS. 1 to 4 mounted on a male plug member.

Figure 2:
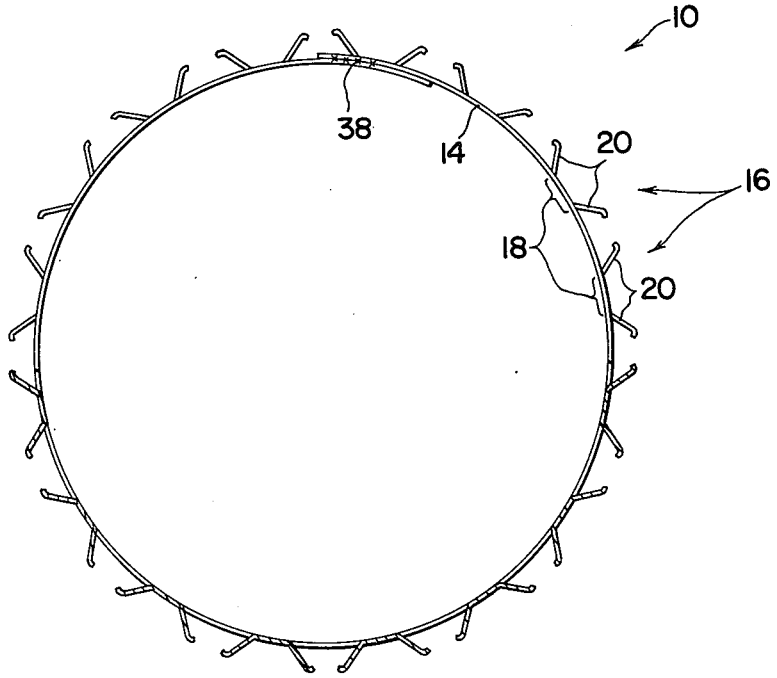
FIG. 2 is an end view of the annulus seen in FIG. 1, partly broken away and taken on an enlarged scale.
Figure 7:
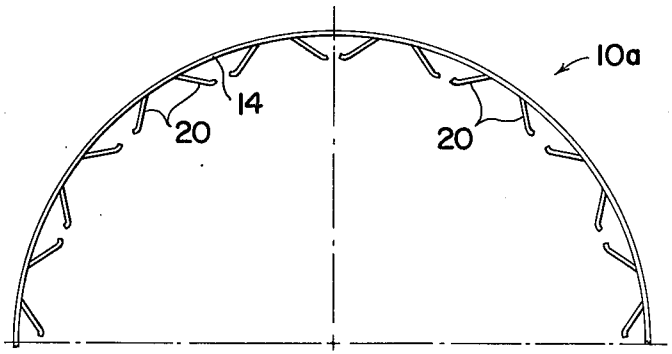

FIG. 7 is a view similar to one-half of FIG. 2 but illustrating a connector strip adapted for mounting in a female member.

FIG. 8 is a view of the connector strip of FIG. 7 mounted in a female member.

FIGS. 9, 10 and 11 illustrate flat connector strips made according to the invention mounted in fork-type, knife-type and butt-type connections, respectively.

Figure 1:
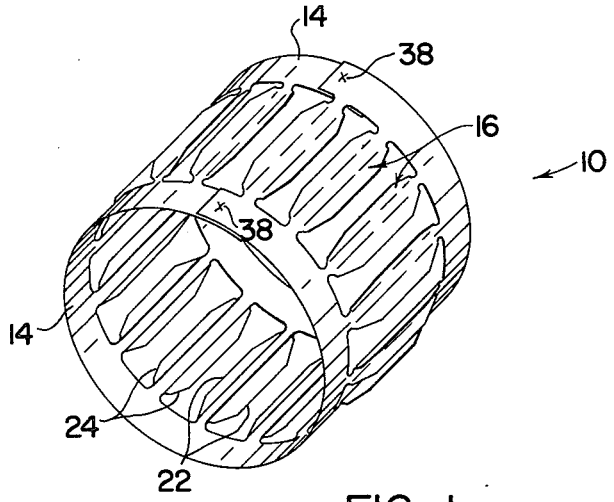

The connector strip 10 shown in FIG. 1 has a pair of annular rail portions 14 between which extend a cylindrical tubular array of louvers 16. The annular rail portions and louvers are all formed from a single piece of sheet metal such as beryllium copper. Typical sheet material thickness for an annulus of about 1 inch diameter may be, say 6 mils. Since the rail portions 14 and the louver 16 are all formed from the same sheet, they are all unitarily connected to each other without any intervening joints or fastenings. The louvers 16 are distributed around the tubular array which they form in spaced relation to each other as seen in FIG. 1.

Each louver 16 comprises a bottom portion 18 extending from one annular rail portion to the other and a pair of upwardly slanting portions 20 on the sides of each bottom portion, as best seen in FIGS. 2 and 4. As best seen in FIGS. 1, 3 and 3A, the flange portions 20 have straight lengthwise edges 22 extending parallel to the axis of the tubular array along the central portions of the lengths of the flange portions 20. Referring to the same figures, the pairs of flange portions 20 associated with each louver have, at both ends, lengthwise edges 24 that are also straight but that taper toward each other and slope down toward the bottom portion 18 of the associated louver. Alternatively, the pairs of flange portions 20 associated with each louver may have tapered edges at only one end if formed from strip cut as shown in FIG. 5. Such arrangement increases the degree of contact associated with each flange 20 but requires that the connector strip be inserted on its mounting member with the tapered ends nearest the mating end of the mounting member. Incorrect mounting can damage the connection and lead to rejection of the product, but may easily occur through carelessness or ignorance. Accordingly it is presently preferred to taper both ends of the louver flanges.

In these respects, the configurations of the edges 22 are similar in shape to the edges 113 of the louvers of the aforementioned Crabbs U.S. Pat. No. 2,217,433 rather than the curvilinear or arcuate contact edges 13 of the aforementioned Neidecker U.S. Pat. No. 3,543,587. However, in the present invention the parallel edges 22 associated with each louver contact the same interconnection surface rather than projecting on opposite sides of the louvers to respectively contact the opposed interconnection louvers, as in Crabbs and Neidecker. This feature of the invention can be advantageously employed even if curvilinear or arcuate contact edges (not illustrated) are used.

The edges 22 and 24 may be ground or, as indicated in FIG. 3A and more clearly shown in FIG. 4, may be slightly lipped to present rounded rather than sharp edges to an associated interconnection surface, to thereby minimize scoring and wear of the surface upon relative movement between the edges during closing and opening of the connection.

Optionally, central slots 26, shown in phantom in FIG. 3 only, may extend along the lengths of the louver bottom portions 18 in order to increase the flexing action of the louver flanges. Variation in the length of these slots in the manufacture of the strips can allow for variation in the stiffness of flexure for different applications, if desired. In many applications no such slots are to be used.

The flat strip with upturned flanges shown in FIG. 3A may be bent into annular shape with the flanges extending radially outwardly as shown in FIGS. 1 and 2, or it may be bent into annular shape with the upturned flanges extending radially inwardly as shown in FIG. 7. In the former case the annulus is adapted for mounting against the cylindrical interconnection surface 28 of a male plug member, as illustrated in FIG. 6; in the latter case the "inside out" annulus **10*a* is adapted for mounting against the cylindrical interconnection surface 30 of a socket member, as shown in FIG. 8**.

End views of the planar developments of the cylindrical interconnection surfaces 28 and 30 are included in FIG. 4 in order to illustrate how the connector strip is mounted against one of the interconnection surfaces 28 or 30 and is deflected by the other of such surfaces. As shown, the bottom portions 18 of the louvers as well as the rail portions 14 are engaged against the interconnection surface 28 or 30 of the male or female member on which or in which the strip is mounted. As the male and female members are mated, the tapering edges 24 (FIG. 3A) at one end of the louver array engage the complementary interconnection surface 30 or 28 or the other connector member, and when the plug is fully inserted, the upfolded flanges are deflected as shown in FIG. 4, with the straight lengthwise edges 22 of the upfolded flanges pressed against the upper interconnection surface illustrated in FIG. 4 and with the side boundaries or edges 34 of the bottom portions 18 of the louvers forming slightly protruding ridges or ribs pressed against the interconnection surface on which the strip is mounted. The ridges or ribs 34 are formed due to the slight upward deflection of the bottom portion 18 which accompanies the downward deflection of the upfolded flanges 20, as seen in FIG. 4. If the louvers 16 are viewed as shallow channel members, these channels will be understood as interconnecting the interconnection surfaces by means of edge pressure between one of the surfaces and the edges 22 of the channel flanges and rib pressure between the other interconnection surface and ribs 34 formed at the side boundaries of the channel base or bottom portion 18. Electrical performance of the connection is substantially comparable to that of prior art connections using strips which required and depended on edge pressure of louvers against both interconnection surfaces.

In one alternative embodiment, the shallow-channel cross sections seen in FIG. 4 can be modified to a "W" cross section by forming the bottom portion 18 as an inverted "V" (not shown) instead of as a more or less flat section as illustrated. If such an inverted "V" shape is used, it is generally desirable that the legs of the "V" extend at approximately the same angle to the horizontal or to the flanges 20, say 45°, and that the height of the "V" be considerably less than the height of the flanges, say less than 50% of the flange height. In this modification the the bottom points of the "W" are radiused rather than sharp and correspond to the ribs 34.

In other alternatives, the height and width of such just-mentioned inverted "V" can be further reduced. In still another alternative such reduction can be continued to the point where the two bottom points of the "W" merge into a single rib and the inverted "V" disappears and the cross section becomes an upright "V" consisting of the two flanges 20 and a bottom portion consisting of the radiused point of the upright "V".

As shown in FIG. 4, each of the louvers 16 is bilaterally symmetrical with respect to an imaginary plane 36 passing through its center and containing the central axis of the tubular array. In FIG. 4 such plane appears as a perpendicular to the rail portion 14, since the latter is shown in planar condition prior to bending into annular shape. The strip remains substantially unchanged in length whether deflected or undeflected, that is, whether engaged with one or both of the plug-and-socket members. Accordingly in all applications the rail portions 14 may be fixed to themselves as by spot welds 38 (FIGS. 1 and 2) or other means to form permanently closed annuli. The "inside out" annulus 10*a* of FIG. 7 may be similarily welded or otherwise fixed to itself.

These closed annulus constructions are far more stable to handle and to mount than split annulus constructions. Thus the annulus 10 may be reliably mounted in the retaining groove of a male plug member, as shown in FIG. 6, without using undercut edges of the groove to retain the annulus. A removable end cap 40 is provided to allow for removal and replacement of the annulus which may readily be done under field conditions with high reliability and with little risk of changing the shape or quality of the strip. Removable end caps have previously been provided for the split annulus connector strips of the prior art, but such caps have generally been shaped to provide an undercut edge, and the opposite edge of the retaining groove has also been undercut in order to provide a means of grasping and retaining the split annulus connector strips. Alternatively the prior art has used split wire retainers for the split annulus connectors, but annulus replacement without damage has been a chancy thing in that case also, and inadvertent tearing out of strips during cleaning, and jamming due to out-of-round retainer rings, have also been problems.

Similarly, a permanently closed "inside out" annulus made according to the invention, and mounted in a female member as shown in FIG. 8, can be readily removed and replaced in the field without much risk of damage. In order to provide for removal of the permanently closed annulus, a press-fit retainer 42 may be provided. Again, while the prior art has provided similar retainers with undercut edges, the closed annulus of the present invention does not require undercut edges at either side of the retainer groove and can be removed and replaced in a reliable manner and without the great risk of damage to the strip experienced in the prior art when damage-free insertion of an unsupported long strip was attempted.

Since the rails 14 are directly positioned against an interconnection surface 28 or 30 rather than being spaced from both interconnection surfaces as in the prior art, there is less tendency for dirt to collect between the connector strip and the member on which it is mounted. Cleaning of dirt that does collect without removal of the annulus can be more effectively accomplished with much less risk of tearing out or otherwise damaging the strip. When removal and replacement of the strip is indicated for more thorough cleaning, or another purpose such as soldering of the mounting members, this can also be done with much less risk of damage to the strip.

The strip in the unbent condition shown in FIGS. 3A and 4 can be used with flat connectors of various types. Thus the flat strip 10*b* shown in phantom in FIGS. 9, 10 and 11 can be used in the manner illustrated in the fork-type, knife-type and butt-type connections respectively shown in those figures. In each case, the connector strip stays cleaner, and is easier to clean in situ, than the connector strips of prior art.

This disclosure of the invention is not intended to be exhaustive as to all possible embodiments and arrangements, but is by way of example only.

What is claimed is:

1. An electrical connector strip adapted to interconnectingly engage complementary male and female members of a plug-and-socket connector each defining a cylindrical interconnection surface, comprising a strip of annular shape and integrally and unitarily provided with a plurality of resiliently deformable, substantially parallel louvers constituting a cylindrical tubular array of louvers, a pair of annular rail portions of said strip unitarily connecting the louvers at opposite ends of the tubular array, the louvers being distributed around said tubular array in spaced relation to each other, the louvers comprising bottom portions adapted to be supported against one of said cylindrical interconnection surfaces and pairs of flange portions on each side of each bottom portion and slanting upwardly for engagement with the other of said cylindrical interconnection surfaces.

2. A connector strip as in claim 1 wherein central slots extend along the lengths of louver bottom portions.

3. In an electrical connector assembly comprising a male plug member and a female socket member, an electrical connector strip as in claim 1 received in said female member with said louver bottom portions engaged on and supported against said cylindrical interconnection surface of said female member, and with said upwardly slanting flange portions extending inwardly for engagement by said male member.

4. A connector strip as in claim 1, the flange portions having straight lengthwise edges extending parallel to the axis of the tubular array at least along the central portions of the lengths of the flange portions.

5. A connector strip as in claim 4, the pairs of flange portions associated with each louver having, at one end at least, lengthwise edges that taper toward each other and slope down toward the bottom portion of the louver.

6. A connector strip as in claim 5, in which said lengthwise tapering edges are straight.

7. A connector strip as in claim 5, in which the pairs of upwardly extending flange portions associated with each tongue having said lengthwise tapering edges at each end.

8. A connector strip as in claim 1 wherein the louvers are bilaterally symmetrical with respect to imaginary planes passing through their centers and containing the imaginary central axis of the tubular array.

9. A connector strip as in claim 7, said strip remaining substantially unchanged in length whether engaged with one or both of said plug-and-socket members, each of said annular rail portions being fixed to itself to form a closed annulus at its end of said tubular array of tongues.

10. A connector strip as in claim 1, said strip remaining substantially unchanged in length whether or not engaged with said other connector member, said strip being fixed to itself to form a closed annulus.

11. In an electrical connector assembly comprising a male plug member and a female socket member, an electrical connector strip as in claim 9 received on said male member with said louver bottom portions engaged on and supported against said cylindrical interconnection surface of said male member, and with said upwardly slanting flange portions extending outwardly for engagement by said cylindrical interconnection surface of said female member, releasable retainer means for preventing said strip from slipping off the female member, said closed annuli remaining closed when said retainer means is released and during removal and replacement of said strip on said male member.

12. An electrical connector strip comprising a strip integrally and unitarily provided with a plurality of resiliently deformable, substantially parallel louvers constituting an array of louvers, a pair of rail portions of said strip unitarily connecting the louvers, the louvers being distributed along said tubular array in spaced relation to each other, the louvers comprising bottom portions adapted to be supported against one of a pair of complementary interconnection surfaces and pairs of flange portions of each side of each bottom portion and slanting upwardly for engagement with the other of said cylindrical interconnection surfaces, said louvers, when compressed between said interconnection surfaces, establishing contact pressure by rib pressure with the interconnection surface against which the bottom portions of the louvers are supported and by edge pressure of the louver flanges against the complementary interconnection surface.

* * * * *